US005154578A

United States Patent [19]

Miraucourt et al.

[11] Patent Number: 5,154,578

[45] Date of Patent: Oct. 13, 1992

[54] COMPRESSOR CASING FOR A GAS TURBINE ENGINE

[75] Inventors: Carmen Miraucourt, Brie Comte Robert; Gilles L. E. Delrieu, Montgeron, both of France

[73] Assignee: Societe Nationale d'Etude et de Construction de Moteurs d'Aviation "S.N.E.C.M.A.", Paris, France

[21] Appl. No.: 597,024

[22] Filed: Oct. 15, 1990

[30] Foreign Application Priority Data

Oct. 18, 1989 [FR] France ..... 89.13585

[51] Int. Cl.[5] ..... F01D 5/14

[52] U.S. Cl. ..... 415/173.3; 415/116; 415/115

[58] Field of Search ..... 415/115, 116, 173.2, 415/173.3; 60/39.75, 39.29

[56] References Cited

U.S. PATENT DOCUMENTS

| | | | |
|---|---|---|---|
| 3,275,294 | 9/1966 | Allen | 415/115 |
| 3,551,068 | 12/1970 | Scalzo | 415/115 |
| 4,017,207 | 4/1977 | Bell | 415/115 |
| 4,330,234 | 5/1982 | Colley | 415/173.2 |
| 4,403,917 | 9/1983 | Laffittee et al. . | |
| 4,543,039 | 9/1985 | Ruis et al. . | |
| 4,696,619 | 9/1987 | Lardellier . | |
| 4,714,404 | 12/1987 | Lardellier . | |
| 4,804,310 | 2/1989 | Fuller | 415/115 |
| 4,826,397 | 5/1989 | Shook | 415/116 |
| 4,849,895 | 7/1989 | Kervistin . | |

FOREIGN PATENT DOCUMENTS

| | | |
|---|---|---|
| 2534982 | 4/1984 | France . |
| 2640687 | 6/1990 | France . |
| 171699 | 7/1965 | U.S.S.R. . |
| 1027843 | 4/1966 | United Kingdom . |

*Primary Examiner*—Edward K. Look
*Assistant Examiner*—Therese M. Newholm
*Attorney, Agent, or Firm*—Bacon & Thomas

[57] ABSTRACT

The present invention relates to a compressor casing for a gas turbine engine in which an inner casing is radially adjustable so as to maintain a radial clearance between the casing and a rotor as the rotor undergoes radial expansion and contraction. The compressor casing has an outer casing and a concentrically arranged inner casing with a plurality of generally radially extending arms interconnecting the inner and outer casings. The volume between the casings is sealed so as to form a chamber and heated air bled from a downstream stage of the compressor is directed into this chamber such that the heated air contacts the exterior surfaces of the hollow radial arms. The invention also has a system for supplying cooling air to the interior of each of the radial hollow arms including a regulating device so that the cooling air can be selectively applied to the arms.

12 Claims, 3 Drawing Sheets 6
8
4
23
22
27
21
26
33
32
31
18
15
12
14
17
11
16
13
10
37
41
28
25
24
2
9
1
30
42
40
39
38
3
7
5
29

COMPRESSOR CASING FOR A GAS TURBINE ENGINE

BACKGROUND OF THE INVENTION

The present invention relates to a compressor casing for a gas turbine engine, more particularly such a casing having means to vary the innerdiameter of the casing to maintain a minimum clearance between the casing and a rotor located within the casing.

It is common practice to provide a compressor casing with inner and outer concentrically arranged casings, especially in aircraft ducted-fan gas turbine engines.

Such known casings are illustrated in U.S. Pat. No. 4,543,039 as well as French Patent 2,534,982 which also illustrate means for connecting the inner and outer casing portions.

As is well-known in the art, during the operation of such gas turbine engines, the rotor undergoes radial dimension changes depending upon its rotational speed and its temperature. As the speed of the rotor and its temperature increase, the rotor disk, as well as the rotor blades attached thereto, will expand radially outwardly. As the rotational speed of the rotor decreases and/or its temperature decreases, the rotor wheel and the rotor blades will contract radially inwardly.

In order to maintain the optimum gas turbine engine performance, particularly in regard to maintaining a relatively high efficiency as well as a low specific fuel consumption, it is necessary to maintain a certain minimum radial clearance between the tips of the rotor blades and the inner surface of the compressor casing. Quite obviously, it is also necessary to maintain such clearance to prevent any possibility of contact between the rotor and the casing which may cause catastrophic failure of the engine.

A known solution for adjusting the inner diameter of the compressor casings to maintain this radial clearance is set forth in U.S. Pat. No. 4,714,404 which describes a system having mechanical links connected to a control shaft which is driven by an actuating means to radially displace the inner casing of the gas turbine which is formed in segments.

Another example can be found in U.S. Pat. No. 4,696,619 in which linkrods extend between inner and outer casings and means are provided to ventilate the outer casing.

While these known solutions achieve the desired results, they are complex and increase the weight of the gas turbine engine which adversely effects its aeronautical applications. Furthermore, these known systems often require air to be bled from an upstream portion of the compressor to communicate with the ventilating means, such bleeding often degrading the performance of the engine.

Another solution, described in French Patent 2,640,687 utilizes bleed air from the compressor to adjust the inner radius of the compressor casing. The amount of air removed from the compressor is minimized by supplying it to a bellows-type actuator extending between two inner casing portions. This known system is rather delicate in nature, rendering it ineffective for aeronautical applications.

SUMMARY OF THE INVENTION

The present invention relates to a compressor casing for a gas turbine engine in which an inner casing is radially adjustable so as to maintain a radial clearance between the casing and a rotor as the rotor undergoes radial expansion and contraction. The compressor casing has an outer casing and a concentrically arranged inner casing with a plurality of generally radially extending arms interconnecting the inner and outer casings. The volume between the casings is sealed so as to form a chamber and heated air bled from a downstream stage of the compressor is directed into this chamber such that the heated air contacts the exterior surfaces of the hollow radial arms.

The invention also has a system for supplying cooling air to the interior of each of the radial hollow arms including a regulating device so that the cooling air can be selectively applied to the arms. A collection chamber communicating with the interior of each of the arms withdraws the cooling air from the interior of each of the arms.

By selectively applying the cooling air to the interior of the hollow arms, the arms can be made to contract in a radial direction, thereby increasing the radius of the inner casing which is attached to the arms. When the cooling air is shut off, contact between the hollow arms and the heated air will cause them to expand, thereby decreasing the radial dimension of the inner casing. This system permits the radial clearance between the inner casing and the rotor to be maintained throughout all operational phases of the engine using a lesser amount of cooling air than the prior art devices.

DETAILED DESCRIPTION OF THE PREFERRED EMBODIMENTS

Figure 1:
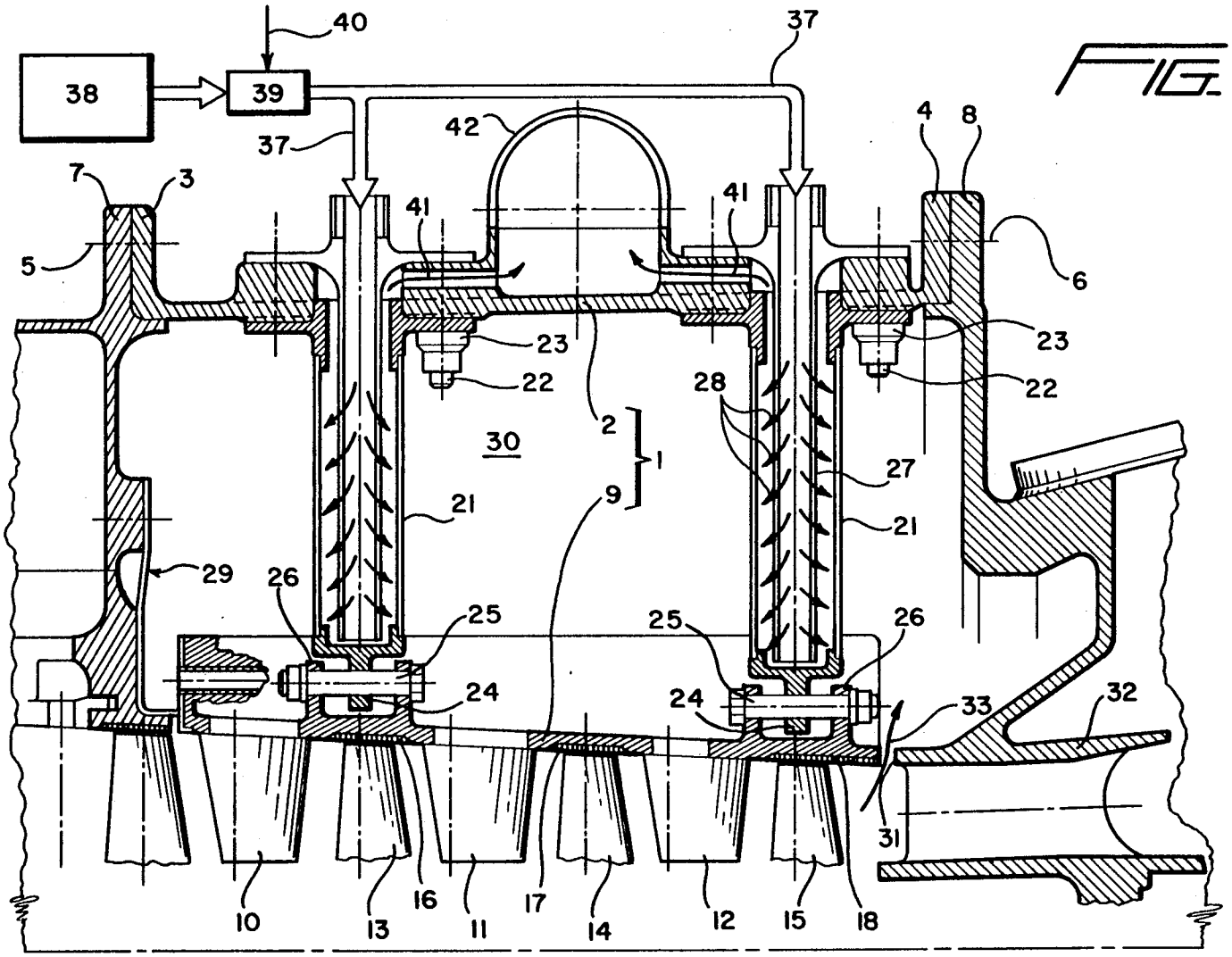
FIG. 1 is a partial, longitudinal cross-sectional view of the compressor casing according to the invention.
Figure 2:
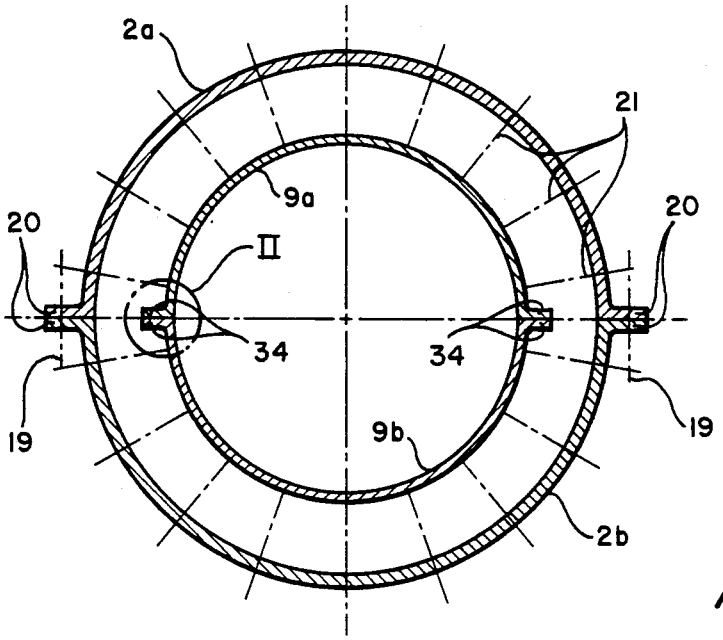
FIG. 2 is a schematic, transverse cross-sectional view illustrating the compressor casing of FIG. 1.

The compressor casing 1 according to the invention is illustrated generally in FIGS. 1 and 2 and comprises an outer casing 2 and an inner casing 9. The outer casing 2 has an upstream flange 3 which is attached to an upstream portion of the compressor-structure 7 by bolts 5 or the like extending through flange 3 and upstream portion 7. Similarly, a downstream portion of the outer casing 2 defines a radial flange 4 which is attached to a downstream structure 8 of the engine by bolts 6 or the like.

In known fashion, inner casing 9 has a plurality of stator vane stages 10, 11 and 12 extending radially inward from an inner surface. A rotor (not shown) is located within the inner casing 9 and has a plurality of stages of blades, illustrated at 13, 14 and 15 which extend between the stator vanes. The tips of the blades of the stages 13, 14 and 15 may bear against abradable material bands 16, 17 and 18 located on the inner surface of the inner casing 9 in known fashion. As is well-known in the art, these bands are abraded by the blade tips during initial operation of the engine so as to form a radial clearance between the blade tips and the circular bands.

The compressor casing according to the invention will be described in conjunction with its use as a casing for a high pressure gas turbine engine compressor, although it should be understood that the principles explained herein may be utilized with other casing applications.

As can best be seen in FIG. 2, the outer casing 2 is generally cylindrical in shape and may be comprised of semi-cylindrical portions 2*a* and 2*b* having mating flanges 20. The flanges 20 may be attached together via bolts or fasteners 19 extending through the flanges 20.

The inner and outer casings 9 and 2 are attached together via a plurality of generally radially extending hollow arms 21. Although eighteen such arms are schematically illustrated in FIG. 2, it is to be understood that more or less number may be utilized, depending upon the application of the compressor casing. Also, as illustrated in FIG. 1, several rows of the radially extending hollow arms may be utilized to support the inner casing on the outer casing.

The radially outer-most ends of each of the hollow arms 21 has a flange portion attached thereto defining flanges which bear against a portion of the outer casing 2. The flanges may be bolted in place against the outer casing via bolts 22 and captive nuts 23.

The radially innermost ends of each of the hollow arms 21 is fixedly attached to the inner casing 9. This attachment may comprise a clevis 26 formed on the inner casing 9 and an eye portion 24 formed on each of the hollow arms 21 and extending into the clevis 26. A bolt 25 or the like extends through the clevis 26 and eye 24 to attach the innermost ends of the arms 21 to the inner casing 9.

A seal member 29 is attached to the upstream structure of the compressor and the upstream portion of the inner casing 9 to provide an air seal between these structures. A chamber 30 is defined between the inner casing 9, the outer casing 2, and the upstream and downstream structures of the compressor as illustrated in FIG. 1. A downstream edge of the inner casing 9 defines, with the edge 31 of the downstream compressor structure, an air bleed opening 33 which allows heated air from a downstream portion of the compressor to enter the chamber 30 as indicated by the arrow in FIG. 1.

Figure 2A:
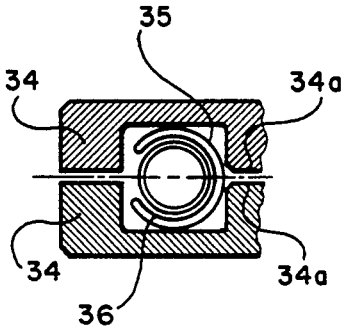
FIG. 2*a* is an enlarged, partial cross-sectional view of the area designated by II in FIG. 2.

The inner casing 9, which is also generally cylindrical in configuration, also comprises two semi-cylindrical portions 9*a* and 9*b* as illustrated in FIG. 2. The portions 9*a* and 9*b* define mating flanges 34 which may be clamped or otherwise attached together in known fashion. The flanges 34 define a clearance 34*a* on the radially innermost sides of casing portions 9*a* and 9*b* as illustrated in FIG. 2*a*. As also illustrated in this FIGURE, each of the flanges 34 define a recess 35 which accommodates a known seal device 36 to seal the space between the clamping flanges 34 as the inner casing 9 expands and contracts.

Perforated tubes 27 extend into the hollow interior of each of the radial arms 21, each of the tubes 27 defining a plurality of openings 28 extending along the length of the tubes. Each of the tubes 27 is connected to a cooling air source 38 via conduits 37. The source of cooling air 38 may comprise a low-pressure stage of the compressor, if desired. A regulating valve system, schematically illustrated at 39, may be incorporated into the conduit 37 to control the flow of the cooling air into the tubes 27. The regulating valve system 39 may be controlled by a signal 40, which may be generated in a known manner as a function of the operating conditions of the gas turbine engine, or in relation to a predetermined control program.

The materials from which the outer casing 2 and the inner casing 9 are fabricated are chosen so as to have a substantially equal coefficient of thermal expansion. Thus, both the inner and outer casings exposed to the heated air in chamber 30 will expand or contract in the same fashion.

Figure 3:
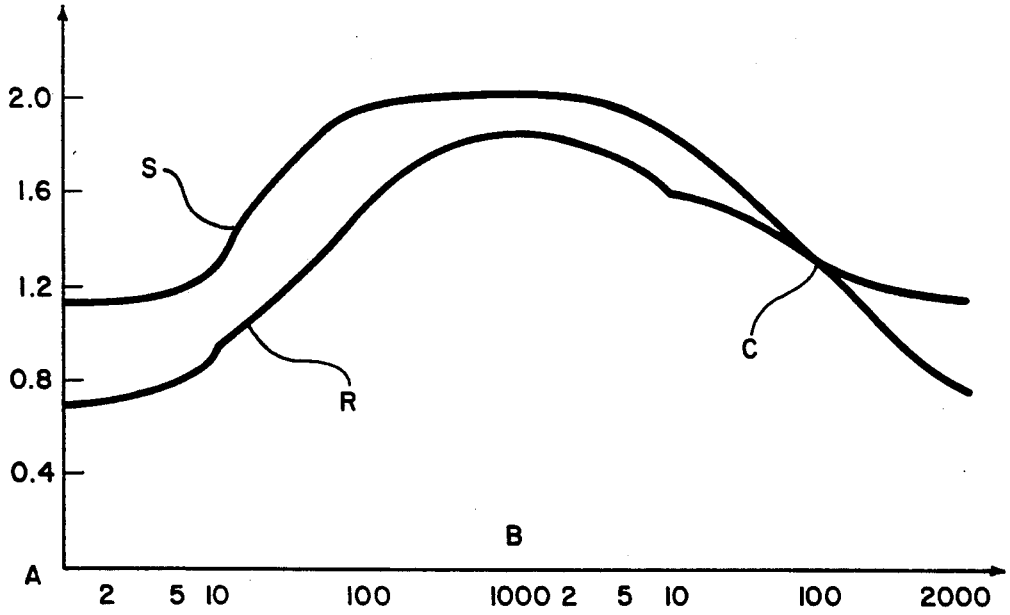
FIG. 3 is a graph of the radial clearance between the rotor blade tips and the inner casing as a function of time.

FIG. 3 is a graph in which the radial displacement d of a point on a rotor blade tip and a corresponding point on the inner casing is plotted as a function of time t. The difference between curves R (rotor displacement) and S (casing or displacement) represent the radial clearance between the blade tip and the inner surface of the inner casing. The graph is plotted during acceleration of the rotor blade from point A to point B on the abscissa. From point B onward, the graph indicates rotor deceleration. Curve S illustrates the corresponding displacements in the radial direction of a corresponding point on the inner casing. As can be seen, during initial deceleration, the rotor contracts more rapidly than does the casing, such contraction being caused by the reduction in rotary speed and the lessening of the centrifugal force acting on the rotor wheel and rotor blades. Such contraction also occurs more rapidly due to the lower thermal inertia of the relatively thin rotor blades.

At a subsequent point in time, the contraction due to the reduction in speed is stabilized and the rotor disk, which has a higher thermal inertia than that of the inner casing 9 begins to contract, although at a slower rate than that of the inner casing 9.

In order to obtain the best performance of the gas turbine engine, to improve its efficiency and to lower its specific fuel consumption, the minimum radial clearance should be maintained between the rotor and the compressor casing under steady state operation. The steady state operating point is illustrated at C on the graph in FIG. 3. In the known systems, in order to prevent physical contact between the rotor and the casing during this operating condition, a larger radial clearance than was absolutely necessary was maintained during other portions of the operating stages of the engine.

In accordance with the present invention, however, beginning at the deceleration point B in FIG. 3, the ventilation circuit is opened and the cooling air is supplied to the interior of the hollow arms 21 through the perforations 28 in the tubes 27. This prevents radially inward contraction of the inner casing 9 (which would ordinarily be greater than the contraction of the rotor disk) to thereby prevent any physical contact between the inner casing 9 and the rotor blades. Since this portion of the operation stages is usually quite short compared to the overall engine cycle (being typically 100 seconds long) it thereby necessitates a very small volume of cooling air. Thus, the amount of cooling air bled from the low-pressure stage of the compressor is greatly reduced over the prior art devices.

The cooling air introduced into the interior of the hollow radial arms 21 is ventilated or withdrawn therefrom by passing through passages 41 defined in the outer casing 2 and into an air collection chamber 42, which may also be defined by the outer casing 2. The air in the collection chamber 42 may be used for such known purposes as aircraft cabin pressurization, etc.

The ventilating air may be also supplied to the interior of the radial arms 21 during other operational stages of the engine, such as acceleration or cruising. The invention provides the advantage of minimizing the air consumption at those times in which it is needed to maintain a minimum radial clearance between the rotor and the inner casing.

Figure 4:
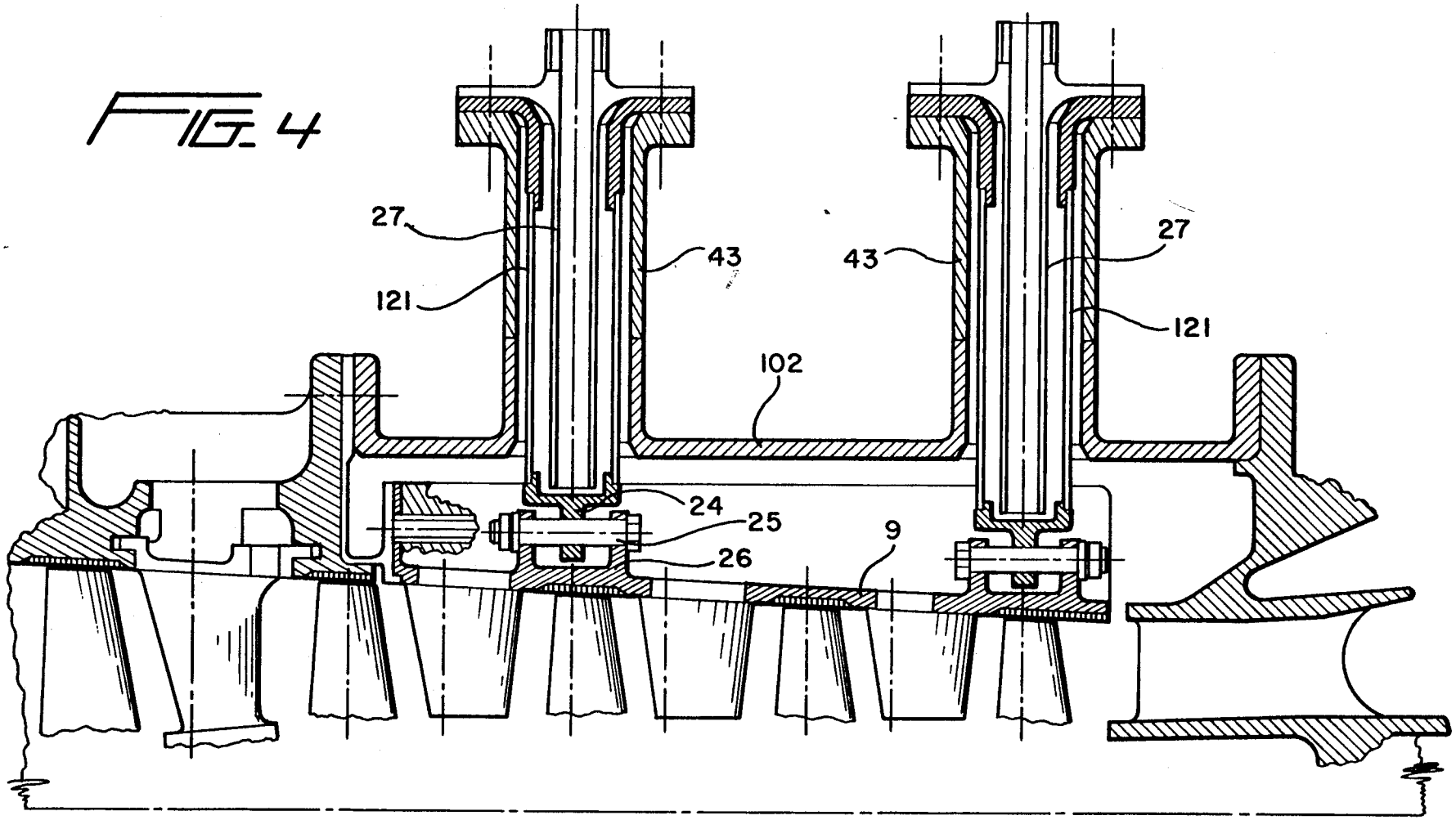
FIG. 4 is a partial, longitudinal cross-sectional view similar to FIG. 1 illustrating an alternative embodiment of the invention.

An alternative structure of the invention is illustrated in FIG. 4. In this embodiment, the inner casing 9 is attached to the innermost ends of the hollow arms 121 in the same fashion as previously described. However, the outer casing 102 is located radially closer to the inner casing 9 in this embodiment than in the embodiment shown in FIG. 1 in order to reduce the overall outer diameter of the compressor casing. The attachment of the upper portions of the hollow radial arms 121 is achieved by attaching their flanges to flange portions 43 extending radially outwardly from the outer casing 102. The operation of the device, as well as the hookup between the tubes 27 and the cooling air system 38 is the same as described in regard to the embodiment shown in FIG. 1.

The foregoing description is provided for illustrative purposes and should not be construed as in any way limiting this invention, the scope of which is defined solely by the appended claims.

I claim:

1. A compressor casing for a gas turbine engine having a rotor with rotor blades wherein the casing extends around the rotor so as to define a radial clearance between the casing and tips of the rotor blades comprising:

a) a generally circular outer casing;

b) a generally circular inner casing located within and spaced radially inwardly of the outer casing so as to be adjacent to the rotor blades;

c) a plurality of substantially hollow arms extending generally radially between the inner and outer casings;

d) means fixedly connecting an end of each arm to the outer casing;

e) means fixedly attaching an opposite end of each arm to the inner casing;

f) means defining a chamber between the inner and outer casings, the chamber enclosing the plurality of arms; and g) means to cause expansion or contraction of the plurality of arms to thereby vary the radial dimensions of the inner casing so as to maintain a desired radial clearance as the rotor radially expands or contracts, said means comprising:

i) means to supply heated air to the chamber such that the heated air contacts the plurality of arms; and, ii) cooling means communicating with each of the arms to selectively supply cooling air to the interior of each arm.

2. The compressor casing of claim further comprising means to evacuate the cooling air from the interior of the arms.

3. The compressor casing of claim wherein the cooling means comprises:

a) a source of cooling air;

b) a perforated tube extending into the interior of each arm; and, c) conduit means interconnecting the source of cooling air with each perforated tube so as to supply the cooling air thereto.

4. The compressor casing of claim 3 further comprising regulating valve means operatively associated with the conduit means to control the flow of cooling air to the radial arms.

5. The compressor casing of claim 3 wherein the source of cooling air comprises a low pressure stage of a compressor.

6. The compressor casing of claim 1 wherein the means for fixedly connecting an opposite end of each arm to the inner casing comprises:

a) a clevis extending from the inner casing;

b) an eye extending from a corresponding arm; and, c) fastener means extending through the clevis and the eye.

7. The compressor casing of claim wherein the means to fixedly connect an end of each arm to the outer casing comprises:

a) a flange extending from each arm so as to bear against a portion of the outer casing; and, b) fastener means extending through the flange and the outer casing.

8. The compressor casing of claim wherein the inner casing is formed of two generally semi-cylindrical portions and further comprising seal means operatively associated between the generally semi-cylindrical portions to prevent air from leaking from the compressor as the radial dimension of the inner casing is varied.

9. The compressor casing of claim 8 wherein the seal means comprises:

a) a recess defined in a mating edge of each of the generally semi-circular portions; and, b) a seal element operatively disposed in the recess.

10. The compressor casing of claim wherein the inner and outer casings are fabricated from materials having substantially equal coefficients of thermal expansion.

11. The compressor casing of claim 2 wherein the means to evacuate the cooling air comprises:

a) an air collection chamber; and, b) passage means defined by the outer casing so as to communicate with the collection chamber and the interior of each of the arms.

12. The compressor casing of claim 1 wherein the means to supply heated air to the chamber comprises means to bleed air from a downstream portion of the compressor into the chamber.

* * * * *

UNITED STATES PATENT AND TRADEMARK OFFICE

CERTIFICATE OF CORRECTION

PATENT NO. : 5,154,578

DATED : October 13, 1992

INVENTOR(S) : MIRAUCOURT et al.

It is certified that error appears in the above-identified patent and that said Letters Patent is hereby corrected as shown below:

Col. 4, line 15, after "casing" delete "or".

Col. 6, line 1, after "claim" insert --1--;
line 4, after "claim" insert --1--;
line 33, after "claim" insert --1--.

Signed and Sealed this

Sixteenth Day of November, 1993

Bruce Lehman

*Attest:*

BRUCE LEHMAN

*Attesting Officer*

*Commissioner of Patents and Trademarks*